US005228583A

United States Patent [19]

Weinstein

[11] Patent Number: 5,228,583

[45] Date of Patent: Jul. 20, 1993

[54] CHILD RESISTANT CAP WITH KEYWAY

[75] Inventor: Jack Weinstein, Manchester Township, Ocean County, N.J.

[73] Assignee: Primary Delivery Systems, Inc., Easton, Pa.

[21] Appl. No.: 660,025

[22] Filed: Feb. 25, 1991

[51] Int. Cl.[5] ..... B65D 55/02

[52] U.S. Cl. ..... 215/220; 215/206; 215/219; 215/330; 215/334

[58] Field of Search ..... 215/219, 203, 204, 206, 215/208, 218, 220, 221, 330, 331, 332, 334, 340, 222

[56] References Cited

U.S. PATENT DOCUMENTS

| | | | |
|---|---|---|---|
| 2,597,307 | 5/1952 | Elkind | 215/220 |
| 2,908,413 | 10/1959 | O'Donnell . | |
| 2,964,207 | 12/1960 | Towns | 215/220 |
| 3,120,318 | 2/1964 | Rigor | 215/206 |
| 3,394,829 | 7/1968 | Peterson | 215/220 |
| 3,447,709 | 6/1969 | Marasco . | |
| 3,468,444 | 9/1969 | Martin . | |
| 3,656,645 | 4/1972 | Fontenelli . | |
| 3,679,085 | 7/1972 | Gach | 215/220 |
| 3,820,676 | 6/1974 | Mucsi | 215/220 |
| 3,822,805 | 7/1974 | Marchant | 215/219 |
| 3,870,182 | 3/1975 | Georgi | 215/220 |
| 4,387,821 | 6/1983 | Geiger | 215/330 |
| 4,641,759 | 2/1987 | Kelley | 215/220 |
| 4,779,747 | 10/1988 | Morel . | |
| 4,998,632 | 3/1991 | Morris, Sr. | 215/201 |

FOREIGN PATENT DOCUMENTS

| | | | |
|---|---|---|---|
| 48973 | 11/1971 | Australia | 215/204 |

*Primary Examiner*—Stephen Marcus
*Assistant Examiner*—Vanessa Caretto
*Attorney, Agent, or Firm*—Kenneth P. Glynn

[57] ABSTRACT

The present invention involves a child resistant closure for containers with threaded necks. It involves an inner cap and an outer cap which engages with one another by ratchets in order to close but these ratchets do not engage when an attempt is made to open the closure. The inner cap and the outer cap are generally cylindrical and have sides and a top, although the outer cap may have an open top. The inner cap has threads on its inside and is adapted to non-removably receive the outer cap so that the outer cap is rotatably engaged therewith. The outer cap is non-removably but rotatably mounted on an engaged with the inner cap. Atleast one keyway slot is located either on the outside of the inner cap or the inside of the outer cap and there is atleast one keyway protrusion extending toward the keyway slot and located on which ever of the inner cap and outer cap does not contain the slot. There are indexes on each of the caps and when they are aligned, the keyway protrusion and the keyway slot will be aligned. The user will align the indexes or indicia and then lift up so that the protrusion fits into the keyway slot. In this manner, the outer cap engages the inner cap so that they are simultaneously rotated for opening. Upon closure, the protrusion will be pushed or dropped out of the slot and the ratchets will engage for proper closure.

11 Claims, 4 Drawing Sheets

CHILD RESISTANT CAP WITH KEYWAY

BACKGROUND OF THE INVENTION

1. Field of the Invention

The present invention is directed to a child resistant closure for containers having threaded necks. More specifically, it is directed to a child resistant closure which involves an inner and an outer cap which easily close by way of ratchets but require certain movements to engage the inner cap and outer cap to effect opening of the closure.

2. Prior Art Statement

There are truly many hundreds of patents covering variations on child proof closures. Many of these rely upon the use of inner caps and outer caps coupled with ratchet engagement and disengagement for closing and more difficult opening. Indeed, the child resistant cap which is currently most popular involves the use of an inner cap and an outer cap with ratchets that easily engage forclosing but require substantial downward force for opening. While this is advantageous in preventing small children from opening medicine containers, it creates serious difficulties for the aged, for people with grip or strength difficulties such as people with arthritis, as well as other types of manual dexterity problems. The present invention is directed toward overcoming the strength requirements while still maintaining a child resistant feature. Significantly, the present invention achieves this by way of a cap which requires only two molded parts in its preferred embodiments.

U.S. Pat. No. 2,908,413 issued to T. J. O'Donnell on Oct. 13, 1959 describes a safety cap which involves an outer cap and an inner ring whereby the bumps or protrusions on the inner cap must be aligned with a slot or opening in a ring on the neck of a threaded bottle in order for the outer cap itself to be effectively unscrewed. This is similar to the present invention in that it requires an alignment of protrusions and subsequent lifting and turning. However, O'Donnell requires manual resetting and realignment in order to properly secure the cap and, in those cases where the protrusions are not aligned, the outer cap may be rotated and cause stresses to the ring thereby damaging the cap. Importantly, O'Donnell is completely lacking in any automatic reset of the safety feature of that device.

U.S. Pat. No. 3,468,444 issued to J. Martin, Jr. on Sep. 23, 1969 is also directed to an inner cap and an outer cap. In this particular invention, the outer cap and inner cap must be properly aligned by setting indexes to one another and then the outer cap must be squeezed so that protrusions fit into recesses in the inner cap so that the inner cap may be engaged for removal. Unfortunately, this invention requires squeezing for opening and closing and does not contribute to overcoming the problem that arthritics and other people who have dexterity and strength would experience. Further, the Martin invention requires alignment and squeezing for retightening the inner cap onto the container.

U.S. Pat. No. 3,447,709 issued to V. Marasco on Jun. 3, 1969 describes a locking cap for bottles which involves the traversal of a particular track coupled with a release type lever or pin. This release handle involves a complicated device and requires a single digit use to effect opening. Further, the device involves complex manufacturing techniques which would be eliminated by the present invention.

U.S. Pat. No. 3,656,645 issued to John Fontenelli on Apr. 18, 1972 describes a two piece safety closure cap which involves a top cap and a ring with engagement of the lip of a container whereby tracks are utilized and proper alignment is necessary in order to open the cap. However, this does not involve the type of arrangement utilized in the present invention where protrusions must be properly aligned and then moved into a keyway slot in order to enable an inner cap and outer cap to rotate together in an opening fashion.

U.S. Pat. No. 4,779,747 issued on Oct. 25, 1988 to Simone Morel involves a container with a three piece safety closure which requires alignments of the three parts so that the top cap may be rotatably removed from the neck of the container. While this invention involves some alignment, it does not involve a keyway slot and requires three components and alignment of these three components in order to effectuate opening of the closure.

Thus, notwithstanding the tremendous quantity of ideas and patents covering safety closures, it is believed that none of the prior art teaches or renders obvious the present invention which involves the use of a keyway system for proper engagement of an inner cap and a outer cap to create a child resistant closure which will be easily operated by users with low strength or weak manual capabilities.

SUMMARY OF THE INVENTION

The present invention involves a child resistant closure for containers with threaded necks. It involves an inner cap and an outer cap which engage with one another by ratchets in order to close but these ratchets do not engage when an attempt is made to open the closure. The inner cap and the outer cap are generally cylindrical and have sides and a top, although one or the other may have an open top. The inner cap has threads on its inside and is adapted to non-removably receive the outer cap so that the outer cap is rotatably engaged therewith. The outer cap is non-removably but rotatably mounted on and engaged with the inner cap. At least one keyway slot is located either on the outside of the inner cap or the inside of the outer cap and there is at least one keyway protrusion extending toward the keyway slot and located on which ever of the inner cap and outer cap does not contain the slot. There are indexes on each of the caps and when they are aligned, the keyway protrusion and the keyway slot will be aligned. The user will align the indexes or indicia and then lift up so that the protrusion fits into the keyway slot. In this manner, the outer cap engages the inner cap so that they are simultaneously rotated for opening. Upon closure, the protrusion will be pushed or dropped out of the slot and the ratchets will engage for proper closure.

BRIEF DESCRIPTION OF THE DRAWINGS

The present invention will be more fully understood and appreciated when the present specification is taken in conjunction with the drawings appended hereto, wherein.

DETAILED DESCRIPTION OF THE PRESENT INVENTION

Figure 1:
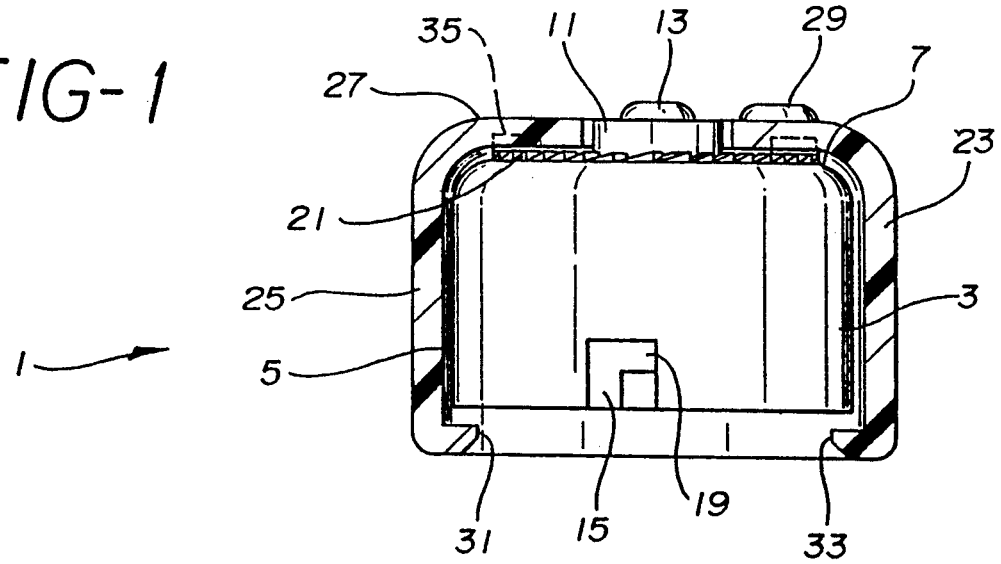
FIG. 1 shows a side view of a present invention closure showing the full inner cap and a cut side view of the outer cap.

The present invention involves a child resistant closure which is believed to be superior to the present commercially available closures which rely upon inner caps and outer caps with ratcheting engagement. As mentioned in the prior art statement, the conventional double cap requires substantial strength in order to be opened in that the outer cap must be pushed downward and twisted simultaneously to properly engage the inner cap for opening such a closure. It is this very feature which renders the cap of the prior art child resistant yet imposes serious problems for the aged, arthritics and other people with dexterity problems. Likewise, it is this deficiency which motivated the development of the present invention herein.

The present invention child resistant closure is for containers with a threaded neck. It includes an inner cap of a generally cylindrical configuration with sides and a top with the threads on its inside. These threads are adapted so as to be screwed downwardly onto and, when reversed, upwardly off a container having a threaded neck. Further, the inner cap is adapted to non-removably receive an outer cap which will the be rotatably engaged thereon. The outer cap of the present invention child resistant closure is likewise generally cylindrical in configuration with sides and a top, although the outer cap may have an open top. The outer cap is non-removably mounted on the inner cap and is rotatable thereon. There is a keyway slot which may be located either on the inside of the outer cap or on the outside of the inner cap. There may be one keyway slot, two such slots or even more, as may be desired. In addition, the other of the inner and outer cap, i.e. the one that does not contain the keyway slot, will contain at least one keyway protrusion and will typically contain as many protrusions as there are slots. These protrusions extend toward the keyway slots and may be engaged with the keyway slots only when two indicia, one located on the inner and one on the outer cap, are aligned with one another. Otherwise, when they are not aligned, the protrusion is free to rotate horizontally, but can not be lift up in any manner to engage with the inner cap. In other words, only when there is an alignment will the keyway slot and keyway protrusion be in vertical alignment and only then, upon lifting will the outer cap and the inner cap cause the keyway slot and keyway protrusion to be engaged so that both the inner cap and outer cap may be rotated together for removal of the present invention closure. In order to effectuate closing of the present invention child resistant closure, ratchet ramps are utilized which operate to engage upon closing but slip past one another upon opening. These ratchets have sets and counterpart sets on either the tops or bottoms or on horizontal rigids or planes or otherwise on both the outer and inner caps. These "ratchet ramps" are not a novel feature of the invention and it should be understood that any equivalent could be used without exceeding the scope of the present invention. In other words, "ratchet ramps" is defined as any type of embossment or protrusion which are located in part on the inner cap and in part on the outer cap which engage in one direction and fail to engage in the opposite direction, i.e. in this case engage upon closing and do not readily engage upon opening.

The keyway protrusion is located in a plane different from keyway slot relative to the tops of the inner and outer caps. In other words, one is higher or lower than the other. Additionally, the keyway slot and keyway protrusion are typically freely rotatable relative to one another in a circular manner in a horizontal plane without being engaged. As mentioned, it is only when the indicia are aligned and the outer cap is lifted up that the keyway slot and keyway protrusion become engaged. Further, upon closure, the protrusion may ride within the keyway slot forclosure but will typically either drop down or be pushed down so as to be freely rotational relative to one another once again, and it will be the ratchet ramps which will assist in assuring simple closure. In other words, the ratchet ramp feature will enable the user to always be able to readily close the present invention closure.

In some embodiments, the protrusions may be located closer to the bottom than the top of the cap on which is located, or otherwise. In other embodiments, the protrusions may be located on the outer cap at a position below the bottom of the inner cap so as to be freely rotatable below the bottom of the inner cap. This will eliminate the need for an extra track or indentation for the rotation of the protrusions and will cut down on the complexity of the mold of the manufacturer as well as reduce the amount of plastic or other material needed for the inner cap.

In another preferred embodiment, multiple protrusions and keyway slots are utilized and they may be directly opposite one another or they may be off from one another, e.g. 190 degrees apart. As an alternative, when multiple protrusions and slots are used, they may have differing topography, i.e. the slots may be of different depths and the protrusions of different heights so that only one particular protrusion will cooperate with only one slot. This will reduce the likelihood of accidental engagement in the case where there are multiple protrusions. In yet another embodiment, a small bump or stop may be included at the beginning of the keyway slot so as to again discourage accidental engagement of the protrusion with the keyway slot, yet this stop should not be of such size that it would maintain the protrusion in the slot upon foreclosure. In yet another embodiment, the keyway slot may be uniquely designed to have a riding feature and slant away from itself in the direction of opening so as to discourage accidental engagement.

Referring now to FIG. 1, there is shown a view of present invention child resistant closure 1 which includes a side cut view of outer cap 23 and a full side view of inner cap 3. In this embodiment, inner cap 3 includes inner cap sides 5 and top 7. The inner cap 3 has a circular extension 11 which extends upwardly and has a generally circular pattern. At top of circular extension 11 is index or indicia 13 for proper alignment of inner cap 3 with outer cap 23. Also located on inner cap 3 is keyway slot 15 which includes a slot leg in the horizontal direction, as shown, as leg 19. Shown in dotted line fashion and located on top 7 of inner cap 3 are ratchet ramps 21 which correspond to a set of ratchet ramps 35 located on top 27 of outer cap 23. These generally engage in the closing direction and are ramped so as to slip over one another in the opening direction. Outer cap 23 has sides 25 and top 27 as well as indicia 29 for alignment, as mentioned. Keyway protrusions 31 and 33 are shown at the bottom of outer cap 25 and literally hang below inner cap 3. They perform both as protrusions for eventual engagement with corresponding keyway slots, such as keyway slot 15 and also act so as to keep outer cap 23 on inner cap 3 on a rotatable but non-removable mounting.

Figure 2:
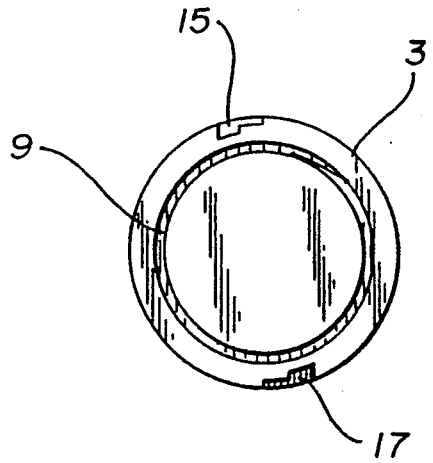
FIG. 2 shows a bottom view of the inner cap shown in FIG. 1.

Referring now to FIG. 2, there is a bottom view of inner cap 3 shown. It includes threads 9 and keyway slots 15 and 17. Threads 9 are located on the inside of inner cap 3 for screwing and unscrewing in conjunction with a threaded neck of a container or bottle such as a medicine bottle. Not shown in the bottom view in FIG. 2 would be the aforementioned ratchet ramps such as ratchet ramps 21 shown in FIG. 1.

Figure 3:
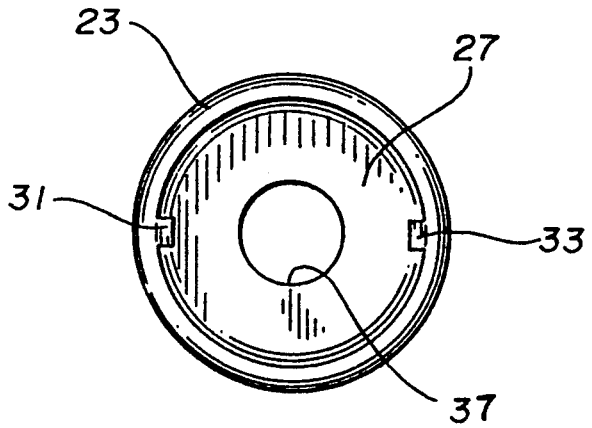
FIG. 3 shows a bottom view of the outer cap which is shown in its side cut view in FIG. 1.

FIG. 3 shows a bottom full view of outer cap 23 with keyway protrusions 31 and 33 located on the inside wall of outer cap 23. Top 27 includes an orifice 37 which fits over circular extension 11 of inner cap 3 which is shown in FIG. 1.

As can be seen, taking FIGS. 1, 2, and 3 together, the present invention closure 1 can be screwed onto a container by ratchet engagement and, if a child tries to unscrew it, the outer cap 23 will merely rotate about inner cap 3. However, in the event that a user first aligns indicia 13 and 29 and then lifts up and rotates in an opening direction, protrusions 31 and 33 will engage with keyway slots 15 and 17 so as to effect proper opening. When the device is screwed back on, most likely outer cap 23 will drop down with the protrusions 31 and 33 dropping out of keyway slots 15 and 17 enabling the ratchet ramps 21 and 35 to engage forclosing. If there is a pulling or upward movement of the outer cap relative to the inner cap during closing, then protrusions 31 and 33 will cooperate with keyway slot 15 to close the present invention closure 1 onto a container or bottle, but this is most unlikely and the ratchets will be generally the primary means of easy closure.

Figure 4:
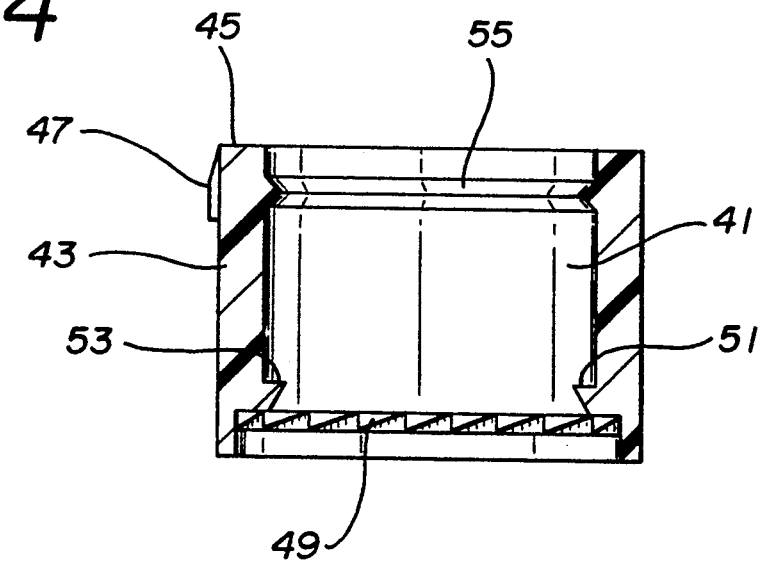
FIG. 4 shows a side view cut view of an outer cap of an alternative preferred embodiment closure of the present invention.
Figure 5:
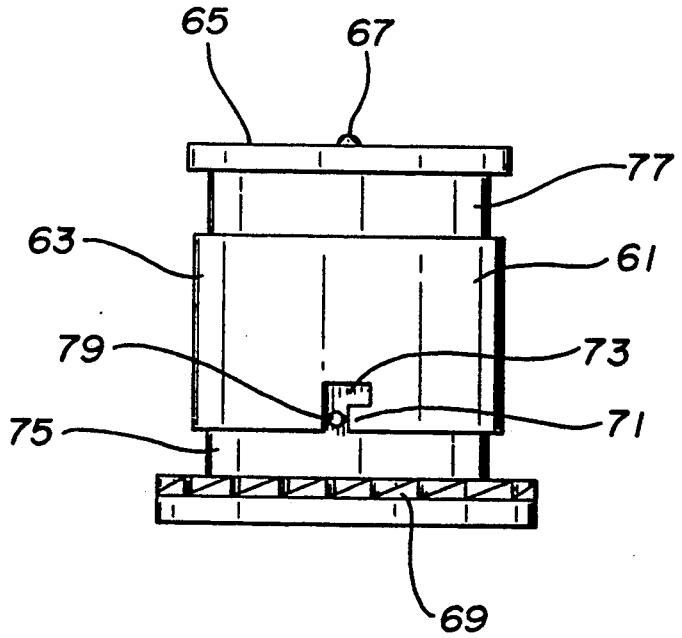
FIG. 5 shows a side view of an inner cap which may be used in conjunction with the outer cap shown in FIG. 4 to create a present invention closure.

FIGS. 4 and 5 respectively show a side cut view of an outer cap 41 and full side view of an inner cap 61 which, together, create an alternative embodiment present invention closure. As shown in FIG. 4, outer cap 41 has wall 43 and top 45. An indicia 47 is located on the side wall of the wall 43, as shown. One way ratchets 49 are located close to the bottom below keyway protrusions 51 and 53. Additionally, ring 55 is included to further assist in maintaining the outer cap 41 in an non-removeable but rotatable nesting or mounting on inner cap 61.

In FIG. 5, inner cap 61 includes a ring track 77 which receives ring 55 of outer cap 41 shown in FIG. 4. Inner cap 61 has side wall 63 and top 65 with indicia 67 located o top 65. Ratchets 69 of outer cap 41 will engage with ratchets 49 shown in FIG. 4. Keyway slot 71 includes a horizontal leg 73 and a partial stop 79. Indentation 75 is located above ratchets 69 and below keyway slot 71 so as to receive protrusions 51 and 53 from outer cap 41 shown in FIG. 4. These protrusions 51 and 53 will ride in a rotatable horizontal fashion about indentation 75, except when a user aligns indicia 47 and 67 and then pulls up. Protrusion 53 will ride over partial stop 79 and engage keyway slot 71 and especially leg 73 so that the outer cap 41 and inner cap 61 will be rotatable together in an opening fashion. Not shown would be threads on the inside wall of inner cap 61.

Figure 6:
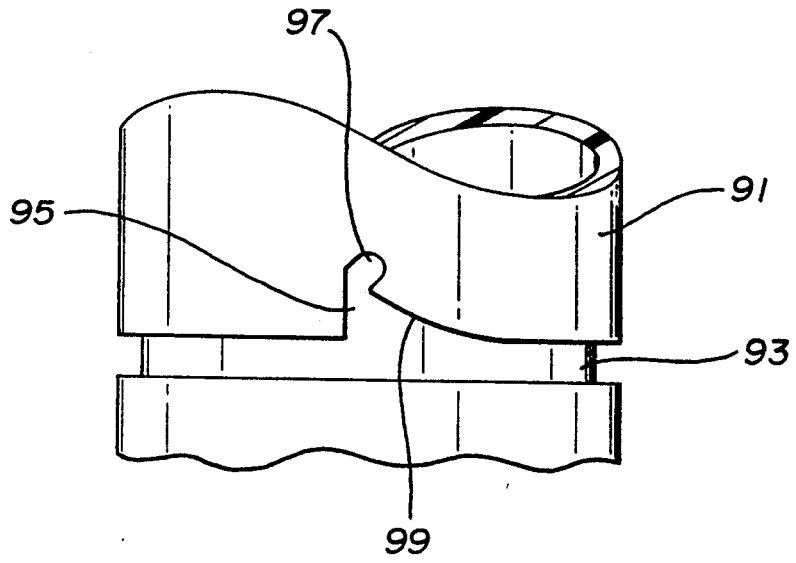
FIG. 6 shows a partial side view of an alternative inner cap of the present invention; and, FIG. 7 shows a side cut view of an alternative embodiment outer cap of a present invention closure wherein the keyway slot is contained in the outer cap.

FIG. 6 shows a partial front view of the inner cap such as one similar to that shown in FIG. 5 and is shown generally as partial inner cap 91. Threads (not shown) are located on the inside thereof and an outer cap such as outer cap 41 shown in FIG. 4 could be utilized in conjunction with this partial inner cap 91 shown in FIG. 6. Indentation 93 encircles inner cap 91 for receiving a protrusion. Keyway slot 95 includes a leg 97 as well as an off ramp 99. When a user who should not be using this container rotates an outer cap and accidentally jumps into the keyway slot 97, because of continued rotation, the protrusion will hit ramp 99 and move downwardly back onto indentation 93 and avoid accidental engaging of keyway slot 97.

Figure 7:
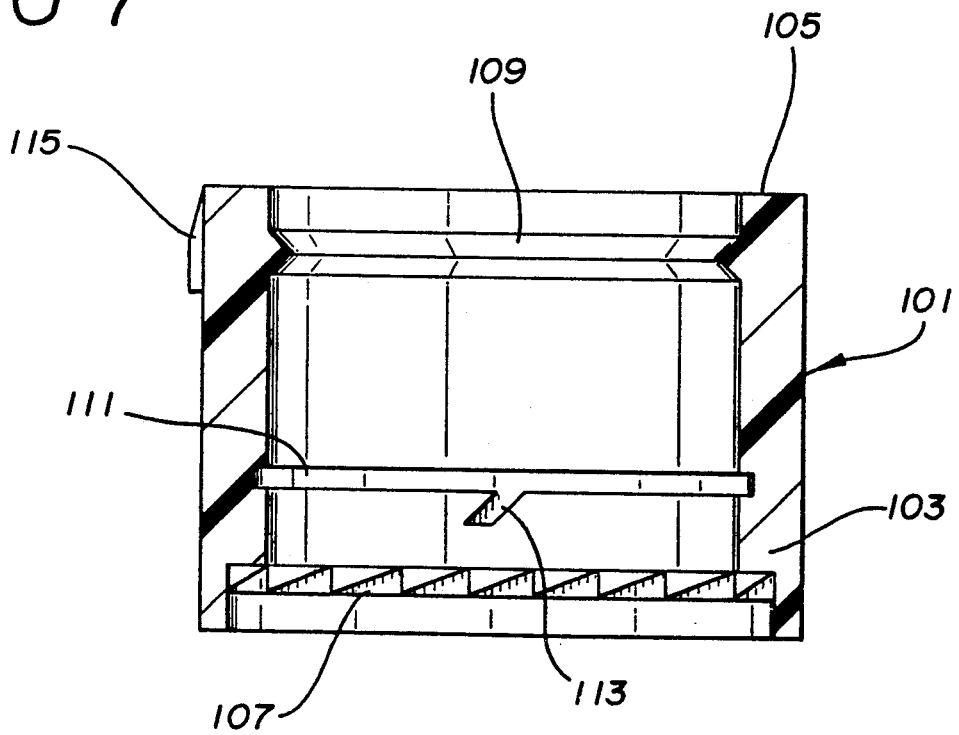

FIG. 7 shows a side cut view of an alternative outer cap 101. This outer cap is similar to outer cap 41 shown in FIG. 4 except that it contains keyway slot 113 and indentation 111 in place of protrusions. Indentation 111 would be completely circular and cut into side 103 as shown. Ratchets 107 would operate effectively in the same manner as ratchets 49 shown in FIG. 4 and likewise ring 109 would engage a ring track on an inner cap. In this embodiment, the inner cap would include a protrusion and when the outer cap were properly aligned by way of indicia 115 and then lifted up a protrusion would enter track 113 and simultaneous unscrewing of this outer cap 101 and an inner cap containing the protrusion would be effected.

Figure 8:
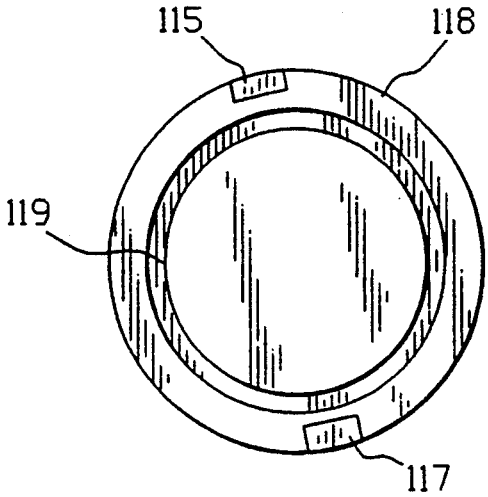
FIG. 8 shows a bottom view of an alternative inner cap of the present invention.
Figure 9:
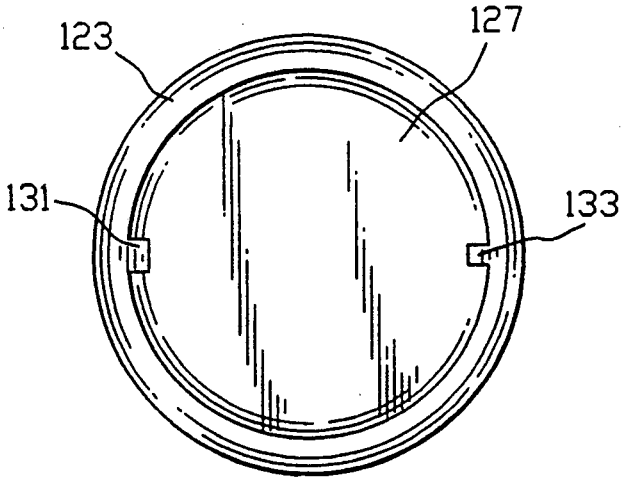
FIG. 9 shows a bottom view of an alternative outer cap of the present invention.

Referring now to FIG. 8, there is a bottom view of inner cap 118 shown. It includes threads 119 and keyway slots 115 and 117. As mentioned herein, the keyway slots may be of different depths, as shown in this embodiment. Threads 119 are located on the inside of inner cap 118 for screwing and unscrewing in conjunction with a threaded neck of a container or bottle. Not shown in the bottom view in FIG. 8 would be ratchet ramps, such as the ratchet ramps 21 shown in FIG. 1. FIG. 9 shows a bottom full view of outer cap 123 including top 127 which would operate in conjunction with the inner cap 118 of FIG. 8. The keyway protrusions 131 and 133 are located on the inside wall of outer cap 123 and correspond in size to keyway slots 117 and 115, respectively. Obviously, numerous modifications and variations of the present invention are possible in light of the above teachings. It is therefore understood that within the scope of the appended claims, the invention may be practiced otherwise than as specifically described herein.

What is claimed is:

1. A child resistant closure for a container having a threaded neck, which comprises:

a) an inner cap of a generally cylindrical configuration with sides and a top and having threads on its inside adapted so as to be screwed downwardly onto and, when reversed, upwardly off a container having a threaded neck, and said inner cap being adapted to non-removably receive an outer cap rotatably engaged therewith;

b) an outer cap of a generally cylindrical configuration with sides and a top and being non-removably mounted on said inner cap and rotatably engaged therewith;

c) at least two keyway slots, each being located on one of the outside of said inner cap and the inside of said outer cap and at least two corresponding keyway protrusions, each extending toward one of said keyway slots and located on the other of said outside of said inner cap and the inside of said outer cap wherein said keyway slots have different depths and said keyway protrusions have different depths corresponding to said slots;

d) two indicia, one on said inner cap and one on said outer cap for vertical alignment of said keyway protrusion and said keyway slot; and, e) ratchet ramps located on said inner cap and said outer cap, facing each other and located so as to engage each other when said outer cap is rotated in a direction to screw said inner cap downwardly and to pass over one another when said outer cap is rotated in the opposite direction;

said keyway protrusions being located in a plane different from said keyway slots relative to the tops of said inner and outer caps so as to be freely rotatable in a circular manner in a horizontal plane without engaging said keyway slots and so as to engage with said keyway slots and cause simultaneous rotation of said inner cap and said outer cap when said two indicia are aligned, said outer cap is lifted upwardly to engage the protrusions with the keyway slots, and then said outer cap is rotated, thereby enabling said inner cap to be unscrewed.

2. The closure of claim 1 wherein said outer cap non-removably rests upon said inner cap, said inner cap contains said keyway slots, and said protrusions are located on the inside of said outer cap in a plane below said keyway slots relative to the tops of said inner and outer caps when at rest.

3. The closure of claim 2 wherein said inner cap also contains an indentation at a plane equal to that of said protrusions with a depth sufficient to receive said protrusions, said indentation being a continuous ring about the outside of said inner cap and being connected to said keyway slots.

4. The closure of claim 2 wherein said outer cap has a side height greater than that of said inner cap so as to extend below said inner cap when at rest, and said protrusions are located on the inside of said outer cap at a plane entirely below said inner cap when at rest.

5. The closure of claim 1 wherein said two keyway slots and two keyway protrusions are located at least 120° apart from one another about the side of said inner cap and outer cap.

6. The closure of claim 1 wherein said outer cap contains said keyway slots, said inner cap contains said keyway protrusions and said keyway slots are located on the inside of said outer cap in a plane below said keyway protrusions relative to the tops of said inner and outer caps.

7. The closure of claim 6 wherein said outer cap also contains an indentation at a plane equal to that of said protrusions with a depth sufficient to receive said protrusions, said indentation being a continuous ring about the inside of said outer cap and being connected to said keyway slots.

8. The closure of claim 6 wherein said are at least two keyway slots and two keyway protrusions are located at least 120° apart from one another about the side of said inner cap and outer cap.

9. The closure of claim 1 wherein said outer cap has a centrally located orifice in its top and said inner cap has a centrally located circular extension of slightly less diameter than said orifice and fits into said orifice when said outer cap is non-removably mounted on said inner cap.

10. The closure of claim 1 wherein said keyway slots each contain a stop of sufficient elevation to require a predetermined amount of force to enable said keyway protrusions to enter said keyway slots.

11. The closure of claim 1 wherein said keyway slots first rise generally vertically, have one vertical wall and one wall which is non-vertical and taper away from said vertical wall.

* * * * *